US009664127B2

(12) United States Patent
Dudar

(10) Patent No.: US 9,664,127 B2
(45) Date of Patent: May 30, 2017

(54) SYSTEM AND METHODS FOR MANAGING REFUELING VAPORS

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 193 days.

(21) Appl. No.: 14/313,629

(22) Filed: Jun. 24, 2014

(65) Prior Publication Data

US 2015/0369150 A1 Dec. 24, 2015

(51) Int. Cl.
*F02M 25/08* (2006.01)
*F02D 41/00* (2006.01)

(52) U.S. Cl.
CPC ..... *F02D 41/0032* (2013.01); *F02M 25/0836* (2013.01)

(58) Field of Classification Search
CPC ..... B60K 15/03519; F02D 29/02; F02D 41/0032; F02M 25/0809; F02M 25/0836; F02M 25/08; F02M 25/0854; F02M 25/089; F02M 25/0872
See application file for complete search history.

(56) References Cited

U.S. PATENT DOCUMENTS

| | | | | |
|---|---|---|---|---|
| 5,878,729 | A | 3/1999 | Covert et al. | |
| 5,911,209 | A * | 6/1999 | Kouda | F02M 25/0809 123/198 D |
| 5,950,655 | A | 9/1999 | Benjey | |
| 8,336,526 | B1 * | 12/2012 | Martin | F02M 25/0809 123/518 |
| 8,434,461 | B2 | 5/2013 | Kerns et al. | |
| 2003/0101871 | A1 * | 6/2003 | Scardino | B01D 53/0415 95/279 |
| 2004/0089275 | A1 * | 5/2004 | Kidokoro | F02M 25/0836 123/520 |
| 2011/0295482 | A1 * | 12/2011 | Pearce | B60K 15/03504 701/102 |
| 2013/0220282 | A1 | 8/2013 | Hadre et al. | |

OTHER PUBLICATIONS

Dudar, Aed M. et al., "System and Methods for Diagnosing Premature Refueling Shutoff," U.S. Appl. No. 14/084,207, filed Nov. 19, 2011, 49 pages.

* cited by examiner

*Primary Examiner* — Hai Huynh
*Assistant Examiner* — Gonzalo Laguarda
(74) *Attorney, Agent, or Firm* — James Dottavio; McCoy Russell LLP

(57) ABSTRACT

A method for a fuel system, comprising: during a first condition, directing gasses stripped of fuel vapor from a fuel vapor canister to an engine intake while maintaining a fuel tank isolation valve open. By directing the gasses stripped of fuel vapor the engine intake, a restricted vent line may be bypassed during a refueling event. In this way, premature shutoff events may be mitigated, allowing for a continuous refueling event.

19 Claims, 4 Drawing Sheets

SYSTEM AND METHODS FOR MANAGING REFUELING VAPORS

BACKGROUND AND SUMMARY

Vehicle fuel systems include evaporative emission control systems designed to reduce the release of fuel vapors to the atmosphere. For example, vaporized hydrocarbons (HCs) from a fuel tank may be stored in a fuel vapor canister packed with an adsorbent which adsorbs and stores the vapors. At a later time, when the engine is in operation, the evaporative emission control system allows the vapors to be purged into the engine intake manifold for use as fuel.

In hybrid-electric vehicles, the fuel tank is typically sealed with a fuel tank isolation valve (FTIV). Prior to refueling, fuel vapors in the tank may be vented to the fuel vapor canister by opening the FTIV. During the refueling event, the FTIV is maintained open, so that fuel vapor generated during refueling can be shunted to the canister. Air stripped of fuel vapor is directed to atmosphere via a canister vent line.

However, the canister vent line is prone to becoming restricted due to sand, salt, spiders, etc. entering the conduit. A blocked or restricted vent line may limit the flow of stripped air out of the canister, leading to a fuel tank back pressure. In turn, the fuel tank back pressure may result in a pre-mature shutoff (PSO) of the fuel dispenser. Restrictions at other points in the vent pathway, and other conditions where the rate of refueling vapor generation is greater than the rate of air flow out of the canister vent line can also cause PSOs. Refueling operators made become agitated as the fuel dispenser continually shuts-off before the fuel tank is filled.

The inventors herein have recognized the above issues and have developed systems and methods to at least partially address them. In one example, a method for a fuel system, comprising: during a first condition, directing gasses stripped of fuel vapor from a fuel vapor canister to an engine intake while maintaining a fuel tank isolation valve open. By directing the gasses stripped of fuel vapor the engine intake, a restricted vent line may be bypassed during a refueling event. In this way, premature shutoff events may be mitigated, allowing for a continuous refueling event.

In another example, a method for refueling a vehicle, comprising: depressurizing a fuel tank; removing an access restriction to a fuel filler neck; and responsive to a fuel tank pressure increasing above a first threshold, opening a canister purge valve. In PHEVs, the PCM must stay active during a refueling event in order to depressurize the fuel tank and remove access restrictions to the fuel filler neck, and thus may perform additional mitigating action during the refueling event. In this way, by opening the canister purge valve prior to the fuel tank pressure increasing above a first threshold, gasses stripped of refueling vapors may continue to exit the fuel vapor canister, preventing an increase in back pressure that may otherwise trigger a premature shutoff event.

In yet another example, a fuel system for a vehicle, comprising: a fuel tank comprising a fuel filler neck, a fuel vapor canister coupled to the fuel tank via a fuel tank isolation valve; a canister purge valve coupled between the fuel vapor canister and an engine intake; a canister vent line coupled between the fuel vapor canister and atmosphere; and a controller configured with instructions stored in non-transitory memory, that when executed, cause the controller to: during a first condition comprising a refueling nozzle engaged with the fuel filler neck and dispensing fuel into the fuel tank, opening the fuel tank isolation valve; and responsive to a fuel tank pressure increasing above a first threshold, opening the canister purge valve. By opening the canister purge valve when a fuel tank pressure increases above a first threshold, the fuel system can manage refueling vapors even when the rate of fuel vapor generation exceeds the rate of gas flow out of the canister vent line. In this way, the fuel system may be refueled by dispensers with high rates of fuel dispensation without the fuel dispenser shutting off prematurely.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF THE DRAWINGS

FIG. 1 schematically shows an example vehicle propulsion system.

FIG. 2 schematically shows an example vehicle system with a fuel system and an evaporative emissions system.

DETAILED DESCRIPTION

This detailed description relates to systems and methods for managing refueling vapors in a fuel system. In particular, the description relates to systems and methods for venting refueling vapors by opening a canister purge valve under conditions where vapors are generated at a higher rate than can be dissipated via the canister vent line, such as when an air filter in the vent line is restricted or blocked. A refueling event may take place in a hybrid vehicle, such as the hybrid vehicle schematically depicted in FIG. 1. The hybrid vehicle may comprise a fuel system and evaporative emissions system, as depicted in FIG. 2. During the refueling event, refueling vapors may be managed by a method executed by a controller, such as the method depicted in FIG. 3. FIG. 4 shows an example timeline for a refueling event using the method of FIG. 3.

Figure 1:
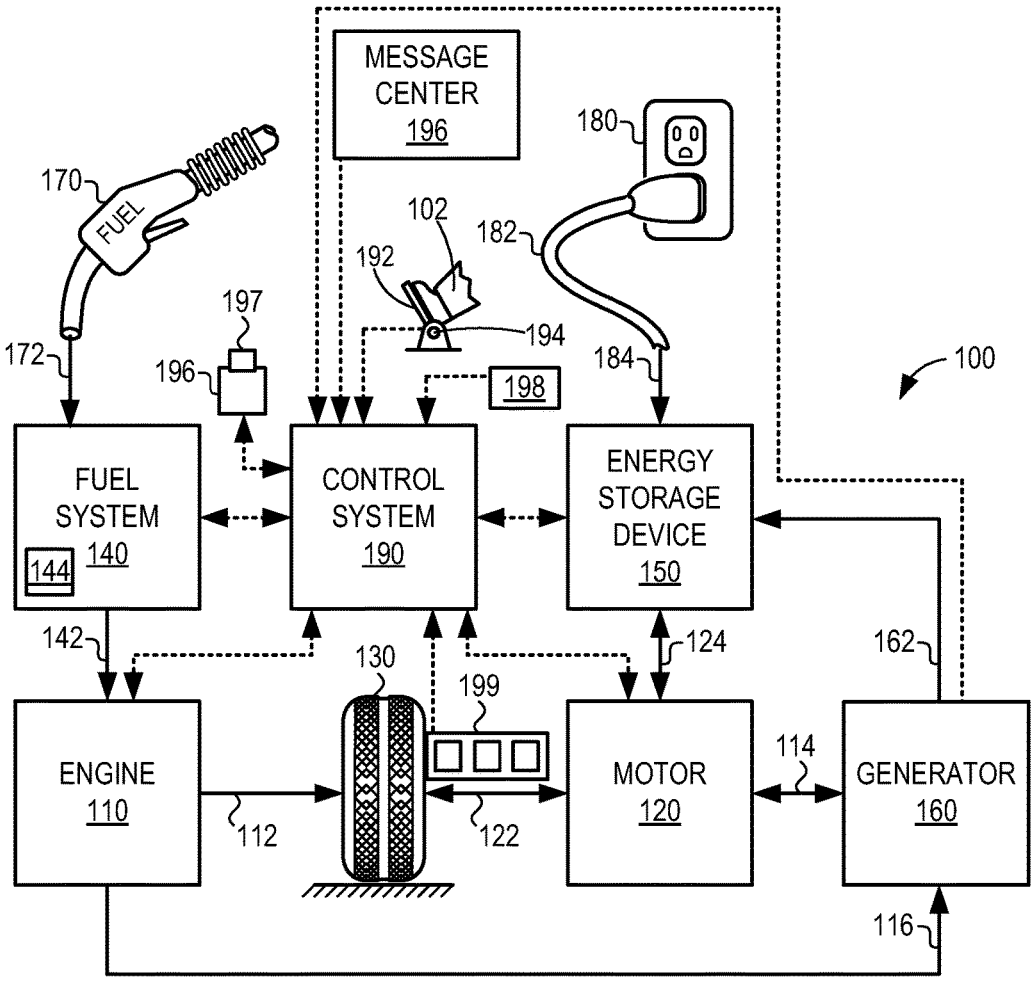
Figure 2:
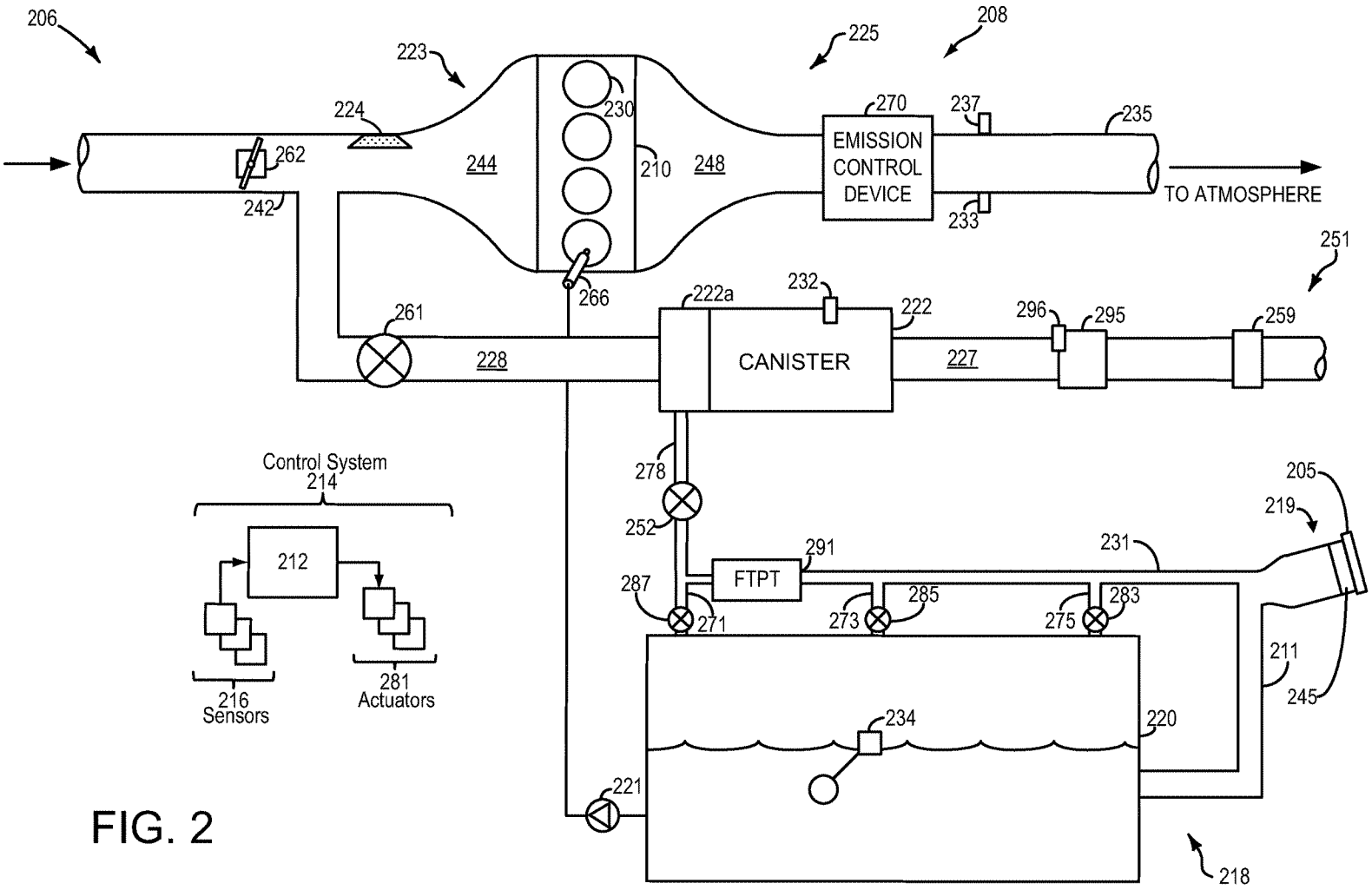

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g. gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (i.e. set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g. E10, E85, etc.) or a blend of gasoline and methanol (e.g. M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. As will be described by the process flow of FIG. 3, control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g. not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g. as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, as described in more detail below, in response to the vehicle operator actuating refueling button 197, a fuel tank in the vehicle may be depressurized so that refueling may be performed.

In an alternative embodiment, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

FIG. 2 shows a schematic depiction of a vehicle system 206. The vehicle system 206 includes an engine system 208 coupled to an emissions control system 251 and a fuel system 218. Emission control system 251 includes a fuel vapor container or canister 222 which may be used to capture and store fuel vapors. In some examples, vehicle system 206 may be a hybrid electric vehicle system.

The engine system 208 may include an engine 210 having a plurality of cylinders 230. The engine 210 includes an engine intake 223 and an engine exhaust 225. The engine intake 223 includes a throttle 262 fluidly coupled to the engine intake manifold 244 via an intake passage 242. An air intake system hydrocarbon trap (AIS HC) 224 may be placed in the intake manifold of engine 210 to adsorb fuel vapors emanating from unburned fuel in the intake manifold, puddled fuel from leaky injectors and/or fuel vapors in crankcase ventilation emissions during engine-off periods. The AIS HC may include a stack of consecutively layered polymeric sheets impregnated with HC vapor adsorption/desorption material. Alternately, the adsorption/desorption material may be filled in the area between the layers of polymeric sheets. The adsorption/desorption material may include one or more of carbon, activated carbon, zeolites, or any other HC adsorbing/desorbing materials. When the engine is operational causing an intake manifold vacuum and a resulting airflow across the AIS HC, the trapped vapors are passively desorbed from the AIS HC and combusted in the engine. Thus, during engine operation, intake fuel vapors are stored and desorbed from AIS HC 224. In addition, fuel vapors stored during an engine shutdown can also be desorbed from the AIS HC during engine operation. In this way, AIS HC 224 may be continually loaded and purged, and the trap may reduce evaporative emissions from the intake passage even when engine 210 is shut down.

The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

Fuel system 218 may include a fuel tank 220 coupled to a fuel pump system 221. The fuel pump system 221 may include one or more pumps for pressurizing fuel delivered to the injectors of engine 210, such as the example injector 266 shown. While only a single injector 266 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may be routed to an evaporative emissions control system 251 which includes a fuel vapor canister 222 via vapor recovery line 231, before being purged to the engine intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, recovery line 231 may be coupled to a fuel filler system 219. In some examples, fuel filler system may include a fuel cap 205 for sealing off the fuel filler system from the atmosphere. Refueling system 219 is coupled to fuel tank 220 via a fuel filler pipe or neck 211.

Further, refueling system 219 may include refueling lock 245. Refueling lock 245 may be any mechanism that may be deployed to provide removable access restriction to fuel filler neck 211. In some embodiments, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling lock 245 may be a filler pipe valve located at a mouth of fuel filler pipe 211. In such embodiments, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some embodiments, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 245 is locked using an electrical mechanism, refueling lock 245 may be unlocked by commands from controller 212, for example, when a fuel tank pressure decreases below a pressure threshold. In embodiments where refueling lock 245 is locked using a mechanical mechanism, refueling lock 245 may be unlocked via a pressure gradient, for example, when a fuel tank pressure decreases to atmospheric pressure.

Emissions control system 251 may include one or more emissions control devices, such as one or more fuel vapor canisters 222 filled with an appropriate adsorbent, the canisters are configured to temporarily trap fuel vapors (including vaporized hydrocarbons) during fuel tank refilling operations and "running loss" (that is, fuel vaporized during vehicle operation). In one example, the adsorbent used is activated charcoal. Emissions control system 251 may further include a canister ventilation path or vent line 227 which may route gases out of the canister 222 to the atmosphere when storing, or trapping, fuel vapors from fuel system 218.

Canister 222 may include a buffer 222*a* (or buffer region), each of the canister and the buffer comprising the adsorbent. As shown, the volume of buffer 222*a* may be smaller than (e.g., a fraction of) the volume of canister 222. The adsorbent in the buffer 222*a* may be same as, or different from, the adsorbent in the canister (e.g., both may include charcoal). Buffer 222*a* may be positioned within canister 222 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine. One or more temperature sensors 232 may be coupled to and/or within canister 222. As fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and estimated based on temperature changes within the canister.

Vent line 227 may also allow fresh air to be drawn into canister 222 when purging stored fuel vapors from fuel system 218 to engine intake 223 via purge line 228 and purge valve 261. For example, purge valve 261 may be normally closed but may be opened during certain conditions so that vacuum from engine intake manifold 244 is provided to the fuel vapor canister for purging. In some examples, vent line 227 may include an air filter 259 disposed therein upstream of a canister 222.

In some examples, the flow of air and vapors between canister 222 and the atmosphere may be regulated by a canister vent valve coupled within vent line 227. When included, the canister vent valve may be a normally open valve, so that fuel tank isolation valve 252 (FTIV) may control venting of fuel tank 220 with the atmosphere. FTIV 252 may be positioned between the fuel tank and the fuel vapor canister within conduit 278. FTIV 252 may be a normally closed valve, that when opened, allows for the venting of fuel vapors from fuel tank 220 to canister 222. Fuel vapors may then be vented to atmosphere, or purged to engine intake system 223 via canister purge valve 261.

Fuel system 218 may be operated by controller 212 in a plurality of modes by selective adjustment of the various valves and solenoids. For example, the fuel system may be operated in a fuel vapor storage mode (e.g., during a fuel tank refueling operation and with the engine not running), wherein the controller 212 may open isolation valve 252 while closing canister purge valve (CPV) 261 to direct refueling vapors into canister 222 while preventing fuel vapors from being directed into the intake manifold.

As another example, the fuel system may be operated in a refueling mode (e.g., when fuel tank refueling is requested by a vehicle operator), wherein the controller 212 may open isolation valve 252, while maintaining canister purge valve 261 closed, to depressurize the fuel tank before allowing enabling fuel to be added therein. As such, isolation valve 252 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 212 may open canister purge valve 261 while closing isolation valve 252. Herein, the vacuum generated by the intake manifold of the operating engine may be used to draw fresh air through vent 27 and through fuel vapor canister 22 to purge the stored fuel vapors into intake manifold 44. In this mode, the purged fuel vapors from the canister are combusted in the engine. The purging may be continued until the stored fuel vapor amount in the canister is below a threshold.

Controller 212 may comprise a portion of a control system 214. Control system 214 is shown receiving information from a plurality of sensors 216 (various examples of which are described herein) and sending control signals to a plurality of actuators 281 (various examples of which are described herein). As one example, sensors 216 may include exhaust gas sensor 237 located upstream of the emission control device, temperature sensor 233, pressure sensor 291, and canister temperature sensor 243. Other sensors such as pressure, temperature, air/fuel ratio, and composition sensors may be coupled to various locations in the vehicle system 206. As another example, the actuators may include fuel injector 266, throttle 262, fuel tank isolation valve 253, pump 292, and refueling lock 245. The control system 214 may include a controller 212. The controller may receive input data from the various sensors, process the input data, and trigger the actuators in response to the processed input data based on instruction or code programmed therein corresponding to one or more routines. An example control routine is described herein with regard to FIG. 3

Leak detection routines may be intermittently performed by controller 212 on fuel system 218 to confirm that the fuel system is not degraded. As such, leak detection routines may be performed while the engine is off (engine-off leak test) using engine-off natural vacuum (EONV) generated due to a change in temperature and pressure at the fuel tank following engine shutdown and/or with vacuum supplemented from a vacuum pump. Alternatively, leak detection routines may be performed while the engine is running by operating a vacuum pump and/or using engine intake manifold vacuum. Leak tests may be performed by an evaporative leak check module (ELCM) 295 communicatively coupled to controller 212. ELCM 295 may be coupled in vent 227, between canister 222 and the atmosphere. ELCM 295 may include a vacuum pump for applying negative pressure to the fuel system when administering a leak test. In some embodiments, the vacuum pump may be configured to be reversible. In other words, the vacuum pump may be configured to apply either a negative pressure or a positive pressure on the fuel system. ELCM 295 may further include a reference orifice and a pressure sensor 296. Following the applying of vacuum to the fuel system, a change in pressure at the reference orifice (e.g., an absolute change or a rate of change) may be monitored and compared to a threshold. Based on the comparison, a fuel system leak may be diagnosed.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

During a refueling event, generated fuel vapors are directed through the fuel limit vent valve and through the FTIV to the fuel vapor canister. Gasses stripped of fuel vapor are then directed out of the fuel vapor canister, through the ELCM and air filter and out to atmosphere. Restrictions along this route may increase the fuel vapor pressure in the fuel tank, potentially leading to a pre-mature shutoff event (PSO). For example, a back pressure of ~12 in$H_2O$ may trigger a PSO. Restrictions may occur due to canister aging or blockages, liquid fuel contamination in vent lines, green fuel tanks, high-flow fuel dispensing pumps that cause fuel vapor to be generated faster than can be processed by the EVAP system, air filter clogging, etc. In particular, the air filter may become clogged over time due to sand, salt, spiders, etc. entering the vent line. This may restrict stripped air from exiting the vent line, causing a PSO event. In PHEVs, the controller or powertrain control module is maintained on during the refueling event, as the fuel tank needs to be depressurized and the refueling access lock unlocked prior to refueling. As such, the controller may take mitigating action to manage refueling vapors and prevent a PSO.

Figure 3:
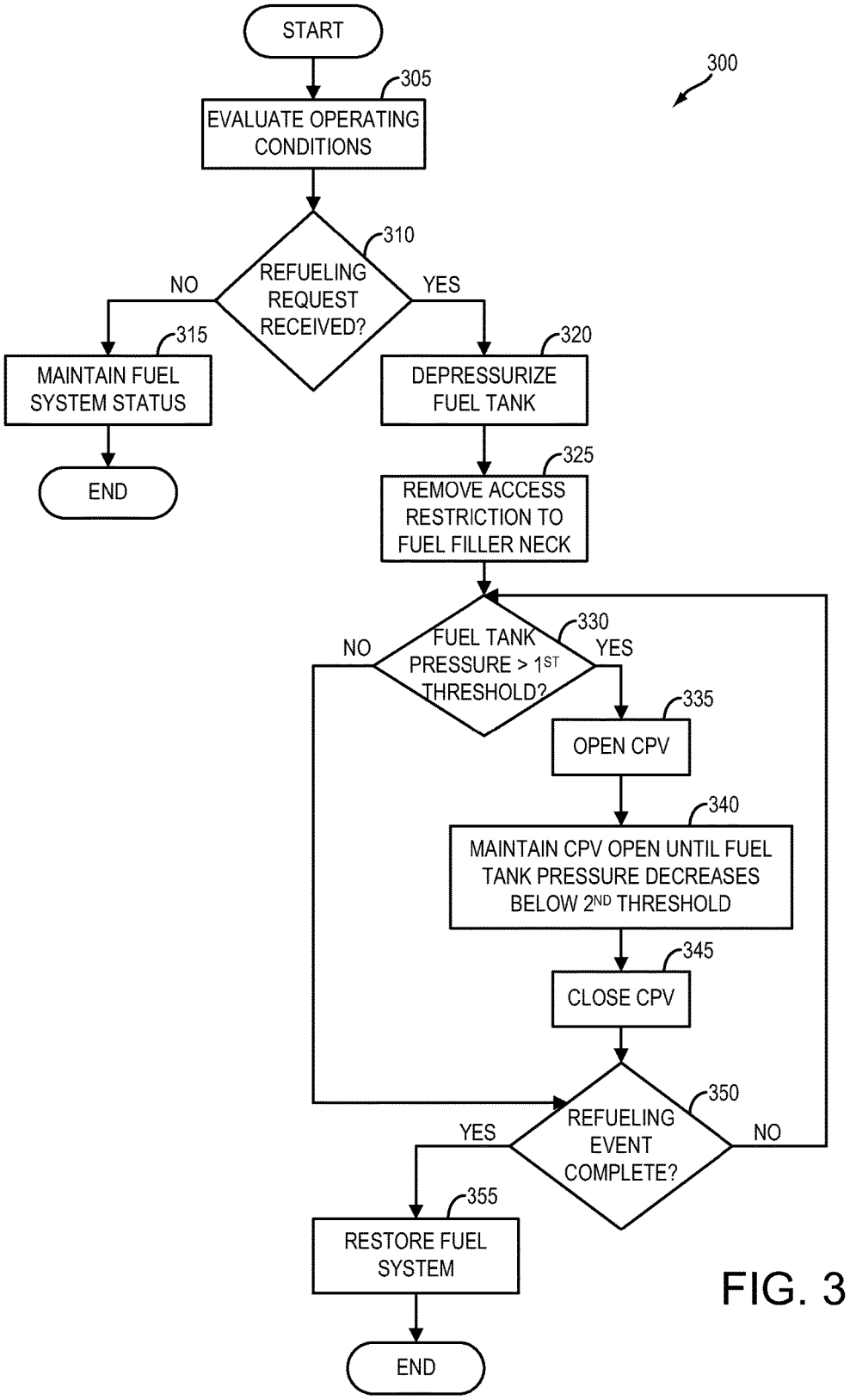
FIG. 3 shows a flow chart for a high-level method for managing refueling vapors during a refueling event.
Figure 4:
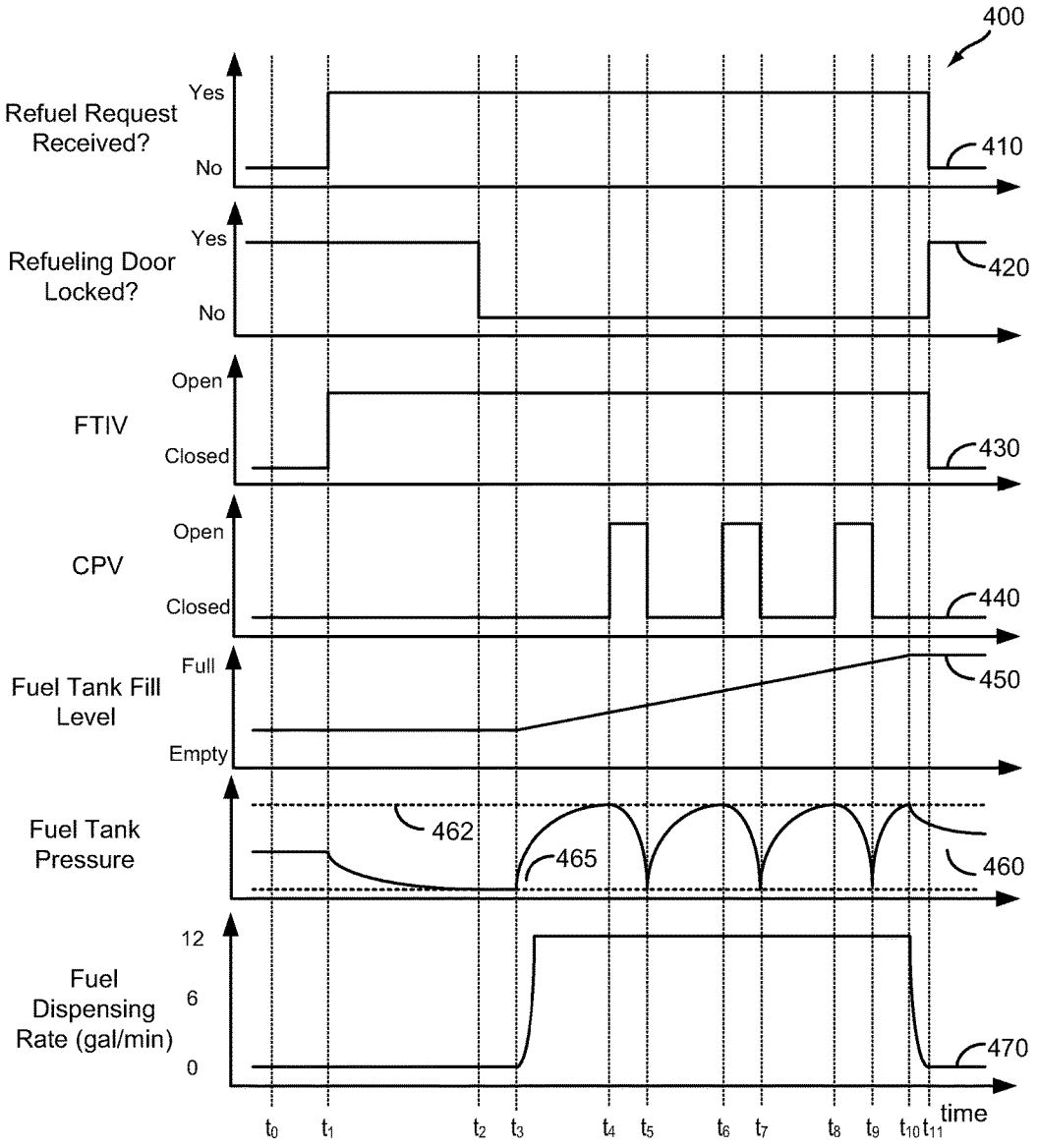
FIG. 4 shows an example timeline for a refueling event using the method of FIG. 3.

FIG. 3 shows a flowchart for an example high-level method 300 for managing refueling vapors during a refueling event. In particular, method 300 may manage fuel tank pressure during refueling by opening the canister purge valve in response to a fuel tank pressure increasing above a threshold. Method 300 will be described with regards to the systems described herein and depicted in FIGS. 1 and 2, though it should be understood that the method may be applied to other systems without departing from the scope of this disclosure. Method 300 may be carried out by controller 212, and may be stored as instructions in non-transitory memory.

Method 300 begins at 305 by evaluating operating conditions. Operating conditions may be measured, estimated or inferred, and may include various vehicle conditions, such as vehicle speed, various engine operating conditions, such as engine operating mode, engine speed, engine temperature, fuel tank pressure, fuel tank fill level, etc., as well as various ambient conditions, such as ambient temperature, humidity, barometric pressure, etc.

Continuing at 310, method 300 includes determining whether a refueling request has been received. For example, a refueling request may comprise a vehicle operator depression of a button, e.g., refueling button 197, on a vehicle instrument panel in the vehicle, e.g., instrument panel 196. In some examples, a refueling request may comprise a refueling operator requesting access to fuel filler neck 211, for example, by attempting to open a refueling door, and/or attempting to remove a gas cap. In some examples, a refueling request may comprise detecting a proximity of the vehicle to a refueling station, for example, via an on-board GPS, or via wireless communication between the vehicle and a refueling pump. A refueling request may include the operating conditions meeting other entry conditions for a refueling event, including, for example, an engine-off event, a fuel tank fill level less than a threshold, etc.

If a refueling request is not received, or entry conditions for a refueling event are not met, method 300 may proceed to 315. At 315, method 300 includes maintaining the status of the fuel system. Method 300 may then end. If a refueling request is received and entry conditions for a refueling event are met, method 300 may proceed to 320. At 320, method 300 includes depressurizing the fuel tank. Depressurizing the fuel tank may include venting fuel vapor from the fuel tank until the fuel tank pressure decreases below a threshold. Venting fuel vapor from the fuel tank may include opening FTIV 252, thereby venting fuel vapor from fuel tank 220 to fuel vapor canister 222. FTIV 252 may be opened completely (e.g. 100% duty cycle) or may be opened partially (e.g. <100% duty cycle) in order to prevent rapid depressurization. In some examples, the fuel tank may be depressurized in multiple stages, for example, a first, slow depressurization, followed by a second, rapid depressurization. In some examples, multiple valves of increasing orifice size may be opened in succession. In examples where a restriction exists in the ventilation pathway, the rate of depressurization may be slow, or may plateau after a duration. In such examples, CPV 261 may be pulsed open in order to allow air stripped of fuel vapor to be vented from the fuel vapor canister, thus depressurizing the fuel tank.

When the fuel tank pressure is below a threshold, method 300 may proceed to 325. At 325, method 300 includes removing an access restriction to the fuel filler neck. For example, an access restriction to the fuel filler neck may be removed by unlocking a refueling door or refueling cap, and may be accompanied by a visual or aural signal to the refueling operator that refueling may proceed.

Continuing at 330, method 300 includes determining whether the fuel tank pressure is greater than a first threshold. Fuel tank pressure may be determined via fuel tank pressure transducer 291, or may be inferred based on other available information. The first threshold may be predetermined based on a premature shut-off (PSO) pressure threshold. For example, a pressure of 12 in$H_2O$ may be sufficient to trigger a PSO event. The first threshold may thus be set at a pressure that is less than 12 in$H_2O$. In some examples, the pressure threshold may be based on the fuel fill level (e.g. a fuel tank that is nearly full may allow a higher pressure than a fuel tank that is nearly empty). In some examples, the pressure threshold may be based on the fuel dispensing rate and/or the rate of increase of the fuel tank pressure. For example, a fuel dispensing pump with a high (12 gal/min) dispensing rate may cause a rapid increase in fuel tank pressure. The first threshold may thus be set to anticipate a PSO event based on the increase in pressure. In some examples, the first threshold may be based on a known restriction in the EVAP system. For example, if a diagnostic code has been set indicating a blocked fresh air line, the controller may anticipate a rapid increase in fuel tank pressure regardless of the fuel dispensing rate, and thus set the first threshold to be lower than in scenarios where no restriction is known.

If the fuel tank pressure is greater than the first threshold, method 300 may proceed to 335. At 335, method 300 includes opening canister purge valve 261. In this way, gasses stripped of fuel vapor may be vented from fuel vapor canister 222 through purge line 228, thus decreasing the fuel tank pressure and preventing a PSO. Residual hydrocarbons that are not adsorbed by fuel vapor canister 222 may be adsorbed at intake manifold 244 by AIS HC 224. Continuing at 340, method 300 includes maintaining the CPV open until the fuel tank pressure decreases below a second threshold, less than the first threshold. For example, the second threshold may be similar to the depressurization threshold described at 320. Continuing at 345, method 300 includes closing the CPV upon the fuel tank pressure decreasing below the second threshold. In some scenarios, the CPV may be maintained open for a majority of or the duration of the refueling event. For example, if vent line 227 is completely restricted, and the fuel dispensing rate is relatively high (e.g. 12 gal/min), the CPV may be maintained open regardless of the fuel tank pressure until the refueling event is complete.

Returning to 330, if the fuel tank pressure is less than the first threshold, method 300 may proceed to 350. Method 300 may also proceed to 350 from 345 after closing the CPV. At 350, method 300 may include determining whether the refueling event is complete. The completion of the refueling event may be indicated by the withdrawal of the refueling nozzle from the fuel filler neck. If the refueling event is not complete, method 300 may return to 330. In this way, the CPV may be pulsed open repeatedly, managing the fuel tank pressure and preventing PSO events throughout the duration of the refueling event. If the refueling event is complete, method 300 may proceed to 355. At 355, method 300 may include restoring the fuel system. Restoring the fuel system may include closing the FTIV, closing the CPV if open, and restricting access to the fuel filler neck. Method 300 may then end.

FIG. 4 shows an example timeline 400 for a refueling event using the example method 300 described herein and depicted in FIG. 3. Timeline 400 includes plot 410, indicating whether a refueling request has been received over time. Timeline 400 further includes plot 420, indicating whether a refueling door is locked over time. Timeline 400 further includes plot 430, indicating whether a fuel tank isolation valve is open over time, and plot 440, indicating whether a canister purge valve is open over time. Timeline 400 further includes plot 450, indicating a fuel tank fill level over time, and plot 460, indicating a fuel tank pressure over time. Line 462 indicates a first fuel tank pressure threshold, while line 465 indicates a second fuel tank pressure threshold. Timeline 400 further includes plot 470, indicating a fuel dispensing rate over time.

At time $t_0$, no refueling request has been received, as indicated by plot 410. Accordingly, the refueling door remains locked, as indicated by plot 420, the FTIV is closed, as indicated by plot 430, and the CPV is closed, as indicated by plot 440. At time $t_1$, a refueling request is received. In response to the refueling request, the FTIV is opened, while the refueling door is maintained locked. The CPV is also maintained closed. With the FTIV open, the fuel tank pressure begins to decrease, as shown by plot 460. At time $t_2$, the fuel tank decreases to the second fuel tank threshold, represented by line 465. Accordingly, the refueling door is unlocked, allowing access to the fuel filler neck.

At time $t_3$, fuel begins to be dispensed into the fuel tank, as shown by plot 470. The fuel tank fill level increases, as shown by plot 450, and the fuel tank pressure also increases, as shown by plot 460. The fuel tank pressure increases from time $t_3$ to time $t_4$, when the pressure reaches the first pressure threshold represented by line 462. At time $t_4$, the CPV is then opened, allowing for gasses stripped of fuel vapor to exit the canister via the purge line. The fuel tank pressure thus decreases, while fuel continues to be dispensed and the fuel tank fill level continues to increase. At time $t_5$, the fuel tank pressure decreases to the second pressure threshold. Accordingly, the CPV is closed.

As fuel continues to be dispensed into the fuel tank, the fuel tank pressure again increases from time $t_5$ to time $t_6$, when the fuel tank pressure reaches the first threshold. Again, the CPV is opened from time $t_6$ to time $t_7$, until the fuel tank pressure decreases to the second pressure threshold. This sequence repeats again, as the fuel tank pressure increases while the CPV is closed from time $t_7$ to $t_8$, and decreases while the CPV is opened from time $t_8$ to time $t_9$.

At time $t_{10}$, the fuel tank reaches a full level. Fuel stops being dispensed, and the fuel tank pressure slowly decreases, although the CPV is maintained closed. At time t11, the refueling event is completed. Accordingly, the FTIV is closed and the refueling door is locked.

The systems described herein and depicted in FIGS. 1 and 2 along with the method described herein and depicted in FIG. 3 may enable one or more systems and one or more methods. In one example, a method for a fuel system, comprising: during a first condition, directing gasses stripped of fuel vapor from a fuel vapor canister to an engine intake while maintaining a fuel tank isolation valve open. The first condition may include an engine-off condition. The first condition may further include a flow of fuel from a fuel dispenser into a fuel tank. The first condition may further include a fuel tank pressure above a first threshold. Directing gasses stripped of fuel vapor from the fuel vapor canister to the engine intake may comprise opening a canister purge valve coupled between the fuel vapor canister and the engine intake. The first condition may further include a rate of fuel vapor generation in a fuel tank that is greater than a gas flow rate out of a vent line coupled between the fuel vapor canister and atmosphere. The fuel tank isolation valve may be coupled between the fuel tank and the fuel vapor canister. The method may further comprise: maintaining the canister purge valve open until the fuel tank pressure decreases below a second threshold, less than the first threshold; and then closing the canister purge valve. The first threshold may be lower than a fuel tank pressure that would trigger a premature shutoff of the fuel dispenser. The technical result of implementing this method is a reduction in premature shut-off events due to a restriction in a vent line. By directing gasses stripped of fuel vapor from the canister to the engine intake, the restriction may be bypassed, allowing for a continuous refueling event despite the restriction.

In another example, a method for refueling a vehicle, comprising: depressurizing a fuel tank; removing an access restriction to a fuel filler neck; and responsive to a fuel tank pressure increasing above a first threshold, opening a canister purge valve. Depressurizing the fuel tank may comprise opening a fuel tank isolation valve. Depressurizing the fuel tank may further comprise: responsive to a rate of fuel tank depressurization being less than a depressurization threshold, opening the canister purge valve. The method may further comprise: maintaining the canister purge valve open until the fuel tank pressure decreases below a second threshold, less than the first threshold; and then closing the canister purge valve. The method may further comprise: following closing the canister purge valve, re-opening the canister purge valve responsive to the fuel tank pressure increasing above the first threshold; and closing the canister purge valve responsive to the fuel tank pressure decreasing below the second threshold. The method may further comprise: responsive to a removal of a refueling nozzle from the fuel filler neck, closing the fuel tank isolation valve; and restricting access to the fuel filler neck. Removing the access restriction to the fuel filler neck may comprise unlocking a refueling door, and restricting access to the fuel filler neck may comprise locking the refueling door. The technical result of implementing this method is a feed-forward means of preventing premature shutoff events during refueling. Vy opening the canister purge valve prior to the fuel tank pressure increasing above a first threshold, gasses stripped of refueling vapors may continue to exit the fuel vapor canister, preventing an increase in back pressure whether or not a vent line restriction has previously been detected.

In yet another example, a fuel system for a vehicle, comprising: a fuel tank comprising a fuel filler neck, a fuel vapor canister coupled to the fuel tank via a fuel tank isolation valve; a canister purge valve coupled between the fuel vapor canister and an engine intake; a canister vent line coupled between the fuel vapor canister and atmosphere; and a controller configured with instructions stored in non-transitory memory, that when executed, cause the controller to: during a first condition comprising a refueling nozzle engaged with the fuel filler neck and dispensing fuel into the fuel tank, opening the fuel tank isolation valve; and responsive to a fuel tank pressure increasing above a first threshold, opening the canister purge valve. The controller may be further configured with instructions stored in non-transitory memory, that when executed, cause the controller to: maintain the canister purge valve open until the fuel tank pressure decreases below a second threshold, less than the first threshold; and then close the canister purge valve. The controller may be further configured with instructions stored in non-transitory memory, that when executed, cause the controller to: following closing the canister purge valve, re-open the canister purge valve responsive to the fuel tank pressure increasing above the first threshold; and close the canister purge valve responsive to the fuel tank pressure decreasing below the second threshold. The first threshold may be lower than a fuel tank pressure that would trigger a premature shutoff of a fuel dispenser coupled to the refueling nozzle. The technical result of implementing this system is a fuel system capable of managing refueling vapors even when the rate of fuel vapor generation exceeds the rate of gas flow out of the canister vent line. In this way, the fuel system may be refueled by dispensers with high rates of fuel dispensation without the fuel dispenser shutting off prematurely.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a fuel system, comprising: during a refueling event: in response to a fuel tank pressure being above a first threshold, directing gasses stripped of fuel vapor from a fuel vapor canister to an engine intake while maintaining a fuel tank isolation valve open, and maintaining a canister purge valve open until the fuel tank pressure decreases below a second threshold when it closes the canister purge valve.

2. The method of claim 1, where the refueling event occurs during an engine-off condition, and where the fuel tank pressure is determined based on a pressure sensor in fluidic communication with a fuel tank.

3. The method of claim 2, where the refueling event includes a flow of fuel from a fuel dispenser into the fuel tank.

4. The method of claim 3, where directing gasses stripped of fuel vapor from the fuel vapor canister to the engine intake comprises opening the canister purge valve coupled between the fuel vapor canister and the engine intake.

5. The method of claim 2, where the fuel tank isolation valve is coupled between the fuel tank and the fuel vapor canister, and wherein the first threshold is based on one or more of a fuel fill level, a fuel dispensing rate, or a rate of fuel tank pressure increase.

6. The method of claim 1, wherein the second threshold is less than the first threshold.

7. The method of claim 3, where the refueling event is detected based on one or more of a refueling request, an operator accessing a refueling door, or a proximity to a fueling station.

8. A method for refueling a vehicle, comprising:
depressurizing a fuel tank;
removing an access restriction to a fuel filler neck;
adding fuel to the fuel tank; and
during the adding of the fuel to the fuel tank,
determining a fuel tank pressure in the fuel tank;
responsive to the fuel tank pressure increasing above a first threshold, opening a canister purge valve; and
responsive to the fuel tank pressure decreasing below a second threshold, less than the first threshold, closing the canister purge valve.

9. The method of claim 8, where depressurizing the fuel tank comprises opening a fuel tank isolation valve, wherein the removing is performed in response to the depressurizing, and wherein the adding fuel is performed in response to the removing.

10. The method of claim 9, where depressurizing the fuel tank further comprises:

responsive to a rate of fuel tank depressurization being less than a depressurization threshold, opening the canister purge valve;

wherein the vehicle is in an engine-off state during the adding.

11. The method of claim 8, further comprising, during the adding of the fuel to the fuel tank:

maintaining the canister purge valve open until the fuel tank pressure decreases below the second threshold.

12. The method of claim 11, further comprising, during the adding of the fuel to the fuel tank:

following closing the canister purge valve, re-opening the canister purge valve responsive to the fuel tank pressure increasing above the first threshold; and closing the canister purge valve responsive to the fuel tank pressure decreasing below the second threshold.

13. The method of claim 11, further comprising:

responsive to a removal of a refueling nozzle from the fuel filler neck, closing a fuel tank isolation valve; and restricting access to the fuel filler neck.

14. The method of claim 11, where removing the access restriction to the fuel filler neck comprises unlocking a refueling door, and where restricting access to the fuel filler neck comprises locking the refueling door.

15. A fuel system for a vehicle, comprising: a fuel tank comprising a fuel filler neck and a fuel tank pressure sensor; a fuel vapor canister coupled to the fuel tank via a fuel tank isolation valve; a canister purge valve coupled between the fuel vapor canister and an engine intake; a canister vent line coupled between the fuel vapor canister and atmosphere; and a controller configured with instructions stored in non-transitory memory, that when executed, cause the controller to: during a first condition comprising a refilling of the fuel tank, opening the fuel tank isolation valve and maintaining the fuel tank isolation valve open until the dispensing is complete; during the first condition, responsive to a fuel tank pressure increasing above a first threshold, opening the canister purge valve and maintaining the canister purge valve open until the fuel tank pressure decreases below a second threshold, less than the first threshold; and during the first condition, responsive to the fuel tank pressure decreasing below the second threshold, closing the canister purge valve.

16. The fuel system of claim 15, wherein the first condition further comprises an engine-off condition; and wherein the first threshold is based on one or more of a fuel fill level, a fuel dispensing rate, or a rate of fuel tank pressure increase.

17. The fuel system of claim 16, where the controller is further configured with instructions stored in non-transitory memory, that when executed, cause the controller to, during the first condition:

following closing the canister purge valve, re-open the canister purge valve responsive to the fuel tank pressure increasing above the first threshold; and close the canister purge valve responsive to the fuel tank pressure decreasing below the second threshold.

18. The fuel system of claim 15, further comprising the fuel tank pressure sensor for determining the fuel tank pressure and a canister pressure sensor for determining a pressure downstream of the fuel vapor canister.

19. The method of claim 1, further comprising depressurizing a fuel tank by opening the fuel tank isolation valve before the refueling event, and in response to a rate of depressurization being less than a depressurization threshold, opening the canister purge valve.

* * * * *